US006928950B2

(12) United States Patent
Trammell et al.

(10) Patent No.: US 6,928,950 B2
(45) Date of Patent: Aug. 16, 2005

(54) MOORING COVER AND METHOD OF USING THE SAME

(75) Inventors: Martha Trammell, Columbia, MO (US); Raymond Cracauer, Middleton, WI (US); Susan St. Clair Smith, Annapolis, MD (US)

(73) Assignee: The Nautical Fishwife LLC, Columbia, MO (US)

( * ) Notice: Subject to any disclaimer, the term of this patent is extended or adjusted under 35 U.S.C. 154(b) by 0 days.

(21) Appl. No.: 10/403,916

(22) Filed: Mar. 31, 2003

(65) Prior Publication Data

US 2004/0187758 A1 Sep. 30, 2004

(51) Int. Cl.[7] ..... A45C 3/00; B65D 85/20

(52) U.S. Cl. ..... 114/382; 190/109; 206/286; 383/38

(58) Field of Search ..... 52/301; 256/11; 114/219, 229, 382, 343, 361–364, 293, 230.1, 230.15, 230.2; 405/216; D03/278–288, 315; 206/286, 287, 287.1, 315.11; 383/4, 38–40; 190/108–111, 119; 220/735, 694

(56) References Cited

U.S. PATENT DOCUMENTS

| | | | | | |
|---|---|---|---|---|---|
| 1,684,232 | A | * | 9/1928 | Levit | 383/38 |
| 2,717,391 | A | * | 9/1955 | Bracken | 2/94 |
| 2,832,389 | A | * | 4/1958 | Smith | 383/9 |
| 3,876,126 | A | * | 4/1975 | Kearney | 224/401 |
| 3,967,666 | A | * | 7/1976 | Farrar | 383/7 |
| 4,535,878 | A | * | 8/1985 | Grahl | 190/1 |
| 4,724,791 | A | * | 2/1988 | McSorley | 114/343 |
| 4,756,455 | A | * | 7/1988 | Kitner et al. | 224/42.11 |
| 4,765,472 | A | | 8/1988 | Dent | |
| 4,773,535 | A | * | 9/1988 | Cook | 206/373 |
| 4,824,168 | A | * | 4/1989 | Makoski | 297/229 |
| 4,901,899 | A | * | 2/1990 | Barrett | 224/223 |
| 4,993,551 | A | | 2/1991 | Lindsay | |
| 5,012,963 | A | * | 5/1991 | Rosenbaum | 224/407 |
| 5,086,917 | A | | 2/1992 | Dziersk et al. | |
| D324,953 | S | * | 3/1992 | Swanner | D12/416 |
| 5,117,724 | A | | 6/1992 | Gardner | |
| 5,174,447 | A | | 12/1992 | Fleming | |
| 5,402,744 | A | * | 4/1995 | Matamoros | 114/55.5 |
| 5,408,782 | A | | 4/1995 | McConnell | |
| 5,427,239 | A | * | 6/1995 | Hunt | 206/372 |
| 5,429,265 | A | * | 7/1995 | Maire et al. | 220/522 |
| 5,481,822 | A | * | 1/1996 | Engels | 43/54.1 |
| D367,794 | S | | 3/1996 | Brawner | |
| 5,511,710 | A | * | 4/1996 | Woods et al. | 224/407 |
| 5,518,342 | A | | 5/1996 | Wright et al. | |
| D372,125 | S | | 7/1996 | Frazier | |
| D376,454 | S | * | 12/1996 | Fierek et al. | D32/54 |
| D380,276 | S | * | 6/1997 | Gaona et al. | D25/68 |
| 5,709,057 | A | | 1/1998 | Johnson, Jr. et al. | |

(Continued)

OTHER PUBLICATIONS

Coastal Engineering Technical Note. Nov. 1984, U.S. Army Engineer Waterways Experimentation, Coastal Engineering Research Center, Vicksburg, Mississippi.

*Primary Examiner*—S. Joseph Morano
*Assistant Examiner*—Ajay Vasudeva
(74) *Attorney, Agent, or Firm*—Thompson Coburn. LLP

(57) ABSTRACT

A mooring cover comprises an apron for substantially surrounding a dock mooring. The apron may have two or more rows of self draining pockets arranged along its length for storing boating accessories and a fastener for securing the opposite ends of the apron about the mooring. A top cover may be provided for covering the top of the mooring as the mooring cover is mounted thereto. In an alternate embodiment, the mooring cover mounts to a railing extending along a dock. In this embodiment, the mooring cover also has an apron with a plurality of self draining pockets arranged along its length for storing boating accessories; however, the mooring cover has a flap extending from the apron adapted to wrap around and attach to the apron for securing the mooring cover to the railing.

6 Claims, 6 Drawing Sheets

U.S. PATENT DOCUMENTS 5,772,066 A * 6/1998 Reynolds ..... 220/694
D410,551 S * 6/1999 Guimont et al. ..... D25/68
5,913,409 A * 6/1999 Test ..... 2/102
5,941,437 A * 8/1999 Okumura ..... 224/585
D414,337 S 9/1999 Hubert
5,947,241 A * 9/1999 Rausch ..... 190/108
5,971,101 A * 10/1999 Taggart ..... 182/129
6,041,729 A 3/2000 Alan
D426,937 S * 6/2000 Auster et al. ..... D2/830
6,085,902 A * 7/2000 Fang ..... 206/373
6,173,931 B1 1/2001 Johnson, Jr. et al.
6,189,697 B1 2/2001 Davis
D444,575 S * 7/2001 Lungo ..... D25/68
D445,202 S * 7/2001 Lungo ..... D25/68
6,296,094 B1 * 10/2001 Knecht ..... 190/107
6,327,989 B1 12/2001 Beach
6,402,002 B1 6/2002 Benton
6,435,389 B1 8/2002 Sucher
6,450,337 B1 * 9/2002 Campagna et al. ..... 206/373
6,467,110 B1 10/2002 Ketcher
6,571,998 B2 * 6/2003 Godshaw et al. ..... 224/607
6,760,943 B2 * 7/2004 Williams ..... 8/159
6,763,986 B2 * 7/2004 Santos et al. ..... 224/585
2002/0088729 A1 * 7/2002 Urbanski ..... 206/373

* cited by examiner

MOORING COVER AND METHOD OF USING THE SAME

BACKGROUND OF THE INVENTION (1) Field of the Invention

The present invention relates to a mooring cover which functions as a storage device and is specifically adapted to be used in connection with a structural element commonly found on a boat dock, for instance a mooring, dock piling or the railing extending therefrom. It is intended that the present invention will be especially useful for boaters and others who work on or with boats alongside docks or piers. In one embodiment of the invention, the mooring cover or storage device fits on top of the mooring or piling and is adapted to hold a boater's personal items, such as, by way of illustration and without limitation, keys, shoes, personal electronic equipment, cell phones, radios, food, and beverages. In another embodiment, the device fits over the railing of the dock. In each case, the mooring cover or storage device allows common boating items to be conveniently stored thereby tidying up the dock area and alleviating potential safety problems. As will become apparent from the disclosure herein, the mooring cover or storage device may also be especially useful for storing boat rigging equipment, such as ropes, hooks, anchors, clips, sail covers, and sails; or the storage device may be especially useful in storing boat cleaning equipment, such as waxes, sponges, cloths, and paint.

(2) Description of the Related Art

Boats in general tend to have a lot equipment and accessories associated with their use. For instance, before using a sail boat, the boat must be outfitted with sails, rope, clips, and many other small fixtures. Often these items are not stored on the boat but are carried by the boater to a dock where the boat is moored. In addition to boat equipment, boaters usually bring many personal items on board the boat, such as wallets, cellular telephones, keys, other personal electronic equipment, and food and beverages. These items are also not typically stored on the boat but are brought by the boater before embarking. These items, together with the lines and other items to be brought on the boat, are often laid out on the dock while the boaters make the boat ready for sail. Typically, street shoes are one item that is left on a dock or a pier while the boat is made ready for sail to prevent "street grit" from damaging the boat's finish. Usually, these items are placed on the dock in a rather haphazard fashion while the boaters scurry around to prepare the boat.

As space on a dock is rather limited, a dock tends to become cluttered rather rapidly as items are unpacked. This creates an inconvenience for the boaters and a potential safety hazard to people on the dock. As these items are spread out on the dock, there tends to be limited space to stand and walk around the dock prior to boarding and de-boarding the boat. Personal items placed on the dock risk being knocked into the water or being blown off the dock by the wind. The lines placed on the dock may become tangled or fall in the water. Sometimes boats are moored adjacent finger piers or gangways that extend from a main pier or dock. Many of these finger piers or gangways are narrow with some being even less than a foot in width, thereby exacerbating the problem of dock clutter.

What is needed is an apparatus that solves these disadvantages by providing a storage device for items that are commonly used on boats, including boater's personal items. Such a device would provide a way to organize the dock, including providing a place to store mooring lines and other boat rigging equipment and a boater's personal belongings while the boat is being made ready for sail or when the boater returns to a dock after sailing.

SUMMARY OF THE INVENTION

The present invention provides a storage device or mooring cover which is adapted to be used with the common pilings, posts or railings used on docks to alleviate dock clutter. The present invention may also be used on the railings and the lifelines of the boat itself. In one aspect of the present invention, the mooring cover substantially surrounds the mooring or piling and provides a convenient place to store items commonly used on the dock. In another aspect of the invention, the mooring cover provides a convenient place to store items commonly used on the dock by attaching to a railing of a type commonly found extending from a post or mooring of a dock. Each of these embodiments of the invention with their different modes of attachment to a structural component of the dock provides versatility and added convenience for the boater.

In one aspect of the present invention, a mooring cover is provided which is adapted for being secured to a mooring supporting a dock. The mooring cover comprises an apron for substantially surrounding the mooring. The apron has a plurality of self draining pockets arranged along its length for storing boating accessories and a fastener for securing the apron about the mooring. In one aspect of the present invention, the fastener is adapted to be tensioned around the mooring to hold the apron in a fixed vertical position on the mooring. In another aspect of the present invention, the mooring cover may have a top covering adjacent the apron and attached to the apron along the adjoining apron length. The top covering may be placed over an exposed mooring top surface to thereby support the mooring cover on the mooring and protect it as well. The mooring cover may also have a carrying strap extending across the top covering which is arranged to allow the storage device to be carried thereby.

The pockets on the apron provide an ideal location for storing one's personal belongings. For instance, some docks are not provided with outdoor lighting. When moving between a boat and a dock at night, there is often inadequate lighting on the dock or pier which in turn creates a safety hazard as well as an inconvenience. In accordance with the present invention, the pocket provides an ideal location for the placement of flash lights so one need not worry about fumbling for a light in the dark. The pocket may also be provided with closures such as draw strings or elastic bands across their openings to secure the contents of the pocket therein.

It is a common practice for marinas and other public docks to reserve a slip for a transient boater. Often, marina owners or public dock owners indicate the slip and other rental information by tacking the information to a piling adjacent the slip. Obviously, the elements can damage the information thereby making it almost impossible to identify the slip as one that has been reserved for the boater. Likewise, when boats are in dry dock or being worked on, instructions for contractors who are working on the boats are often left in a similar manner. Sometimes, these instructions can become destroyed or lost. In accordance with present invention, a pocket on the apron may be made from a weather impervious material to safely contain and display for view important information in the pocket and protect it from environmental elements.

Some mooring or pilings used to construct docks or piers are old and unsightly, and often pilings are made from rough cut wood which generates splinters and damage to objects that brush up against the piling. In accordance with the present invention, the mooring covering may be constructed from durable materials which cover the mooring and prevent damage to the mooring or objects coming into contact with the mooring and also prevent injury to personnel working on the dock. Additionally, by placing mooring coverings on several moorings, one can create a uniform and aesthetically pleasing appearance for an old pier or dock.

To allow the mooring cover to be used on a mooring having a railing, the ends of the apron may be formed in a spaced apart relationship. In this way, the mooring cover may be fitted on a mooring having railings by placing the railing in the space between the ends of the apron. The fastener may extend from the apron ends to assist in securing and stabilizing the mooring covering on the mooring.

The storage device may also be provided with a strap attachment, which may be a loop or a hook which is adapted for holding irregularly shaped or oversized articles and accessories, such as rope or a hand bag, which would not otherwise fit in the provided pocket. The mooring cover may also be provided with handles for grasping as a boater moves between the boat and dock, especially at night, to make it more convenient and safe.

When the mooring cover is to be placed on small diameter posts or irregularly shaped posts, in accordance with the present invention, an adapter spool may be provided which slips over a mooring and provides a regular structure for mounting the mooring cover.

The mooring cover may also be provided with an indicia area that is exposed when the mooring cover is placed on the mooring. The indicia area preferably has indicia thereon which are visible from an area adjacent the dock. The indicia area may have personalized information such as a person's name or address, a boat name, or the indicia area may have advertising information, which may be especially useful for marina owners or other commercial establishments having boat dock accommodations, such as restaurants.

Among the aspects of the present invention is the provision of a method comprising providing a mooring for supporting a dock, a mooring cover comprising an apron having a plurality of self draining pockets arranged along its length for storing boating accessories, and a fastener for securing the apron about the mooring. In accordance with the method of the present invention, the mooring cover is positioned around the mooring in a manner such that the apron substantially surrounds the mooring and the mooring supports the mooring cover.

In accordance with the method of the present invention, the storage device may have a top and a carrying strap extending over the top such that it may be carried by the carrying strap with the apron extending downward. The mooring cover may further comprise a strap attachment on the apron and the method may further comprise using the strap attachment to hold a boating accessory on the storage device. The mooring cover may further comprise a handle on the apron and the method of the present invention may further comprise using the handle to facilitate boarding and unboarding a vessel moored adjacent to the dock.

In another aspect of the present invention, a mooring cover is provided for mounting to a railing extending from a mooring supporting a dock. The mooring cover comprises an apron having a plurality of self draining pockets arranged along its length for storing boating accessories. The mooring cover has a flap extending from the apron adapted to fit around the railing when the mooring cover is releasably attached to the railing.

The present invention provides a device that conveniently stores items commonly left on the dock. The device in turn creates a neat and orderly dock, convenience for boaters, and improves safety in and around the boat and dock area. Further objects and features of the invention are revealed in the following detailed description of the preferred embodiment of the invention and in the drawings which follow.

BRIEF DESCRIPTION OF THE DRAWINGS

Corresponding reference numbers indicate corresponding parts throughout the several views of the drawings.

DETAILED DESCRIPTION OF THE PREFERRED EMBODIMENT

Figure 6:
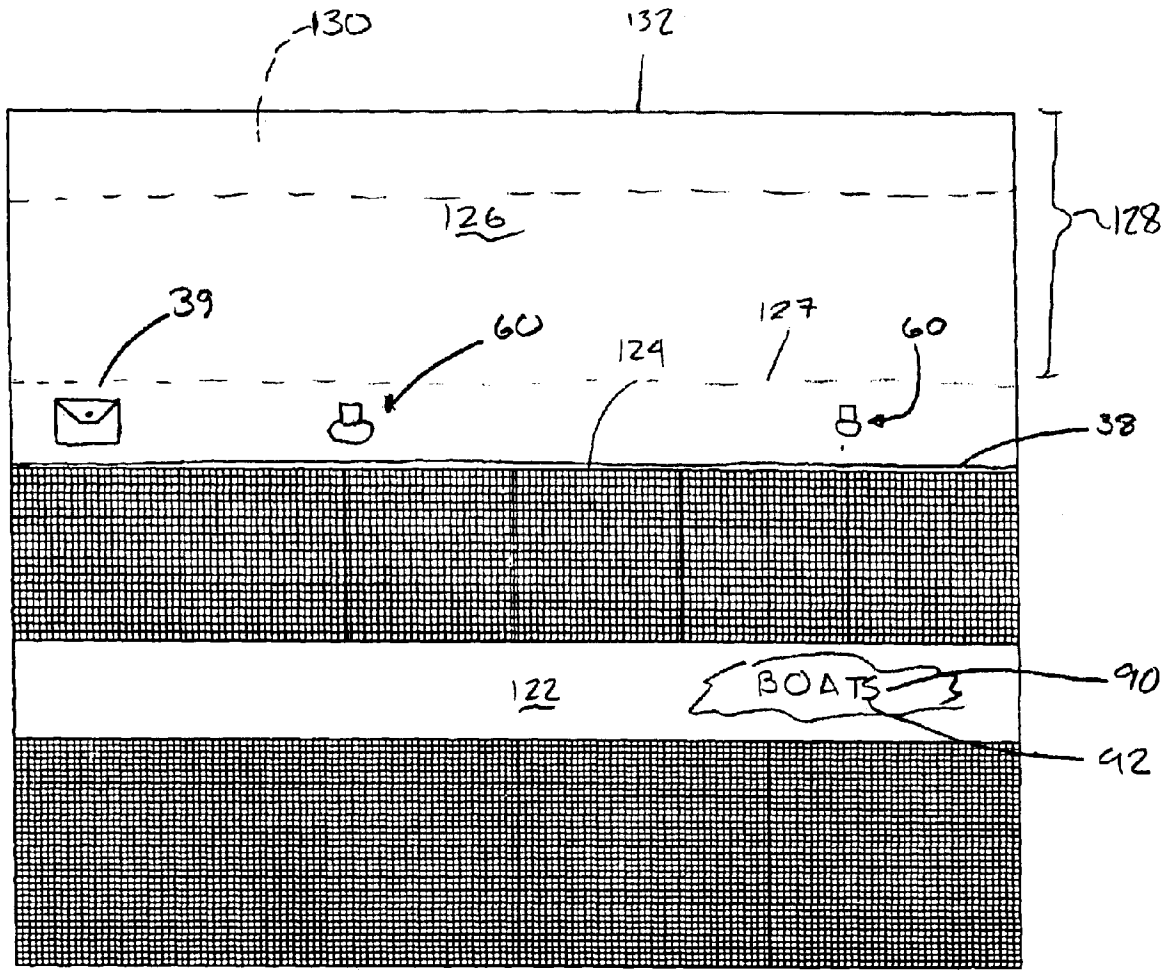
FIG. 6 shows the storage device of FIG. 5 laid flat with its mounting flap fully extended before installation on the dock railing.

FIGS. 1–4 show a first embodiment of a mooring cover 20 of the present invention installed over the top of a mooring or dock piling 22. FIGS. 5 and 6 show a second alternate embodiment of the mooring cover of FIGS. 1–4, and FIG. 7 shows a third alternate embodiment of the mooring cover of FIGS. 1–4.

Figure 1:
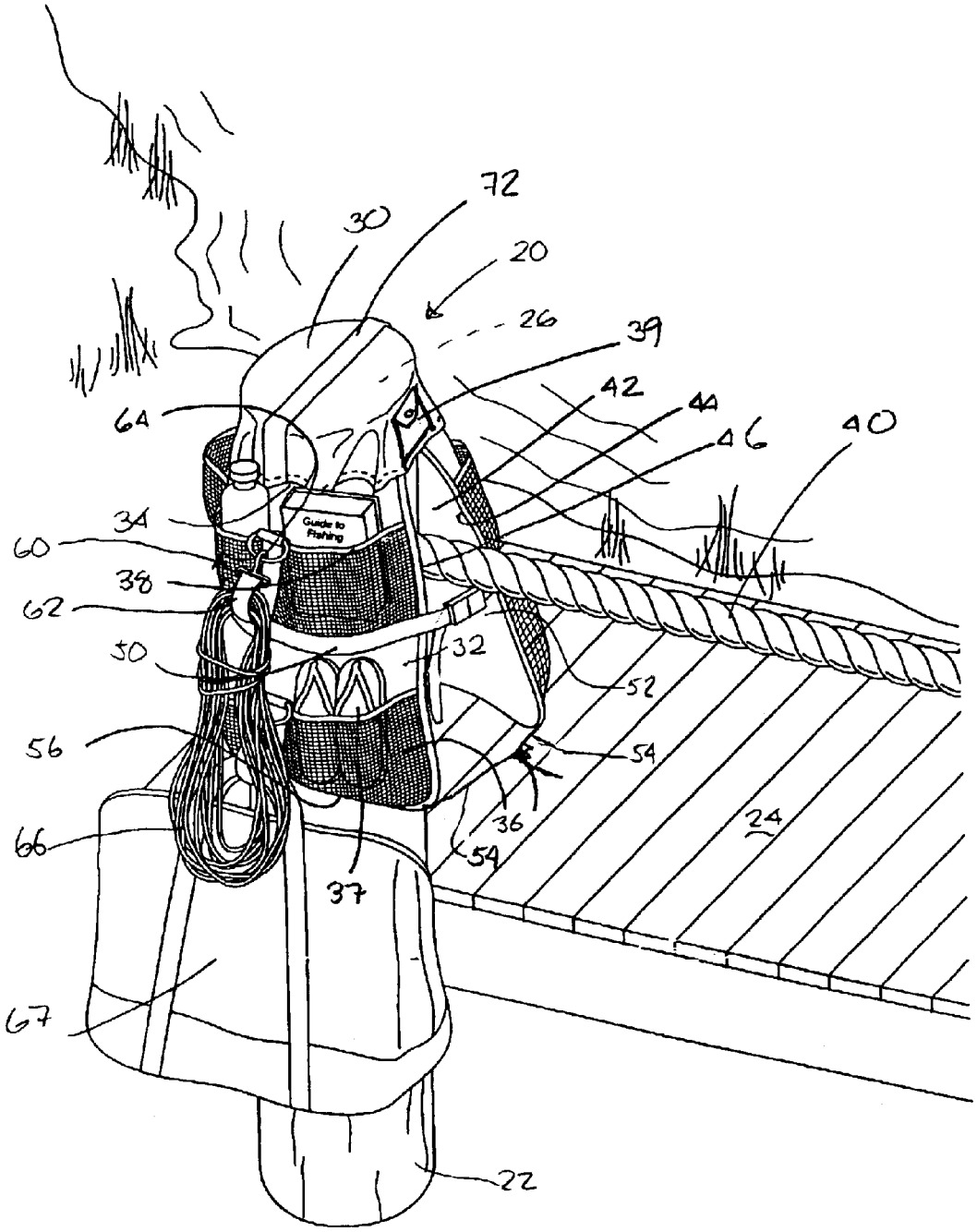
FIG. 1 is a perspective view of the storage device of the present invention installed on a mooring.
Figure 2:
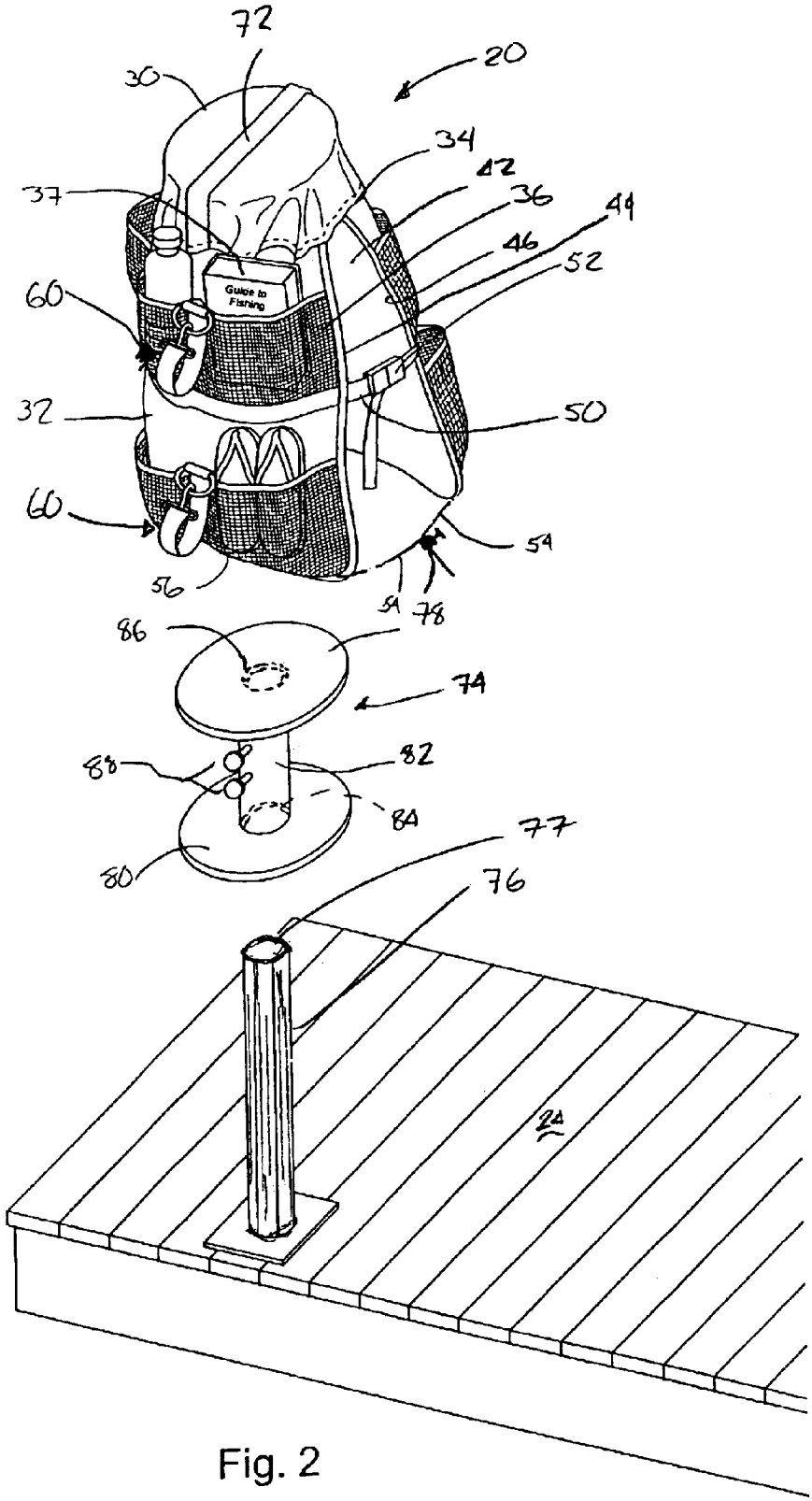
FIG. 2 is an exploded view of the storage device being placed on a mooring having a small diameter via use of a spool adapter.
Figure 3:
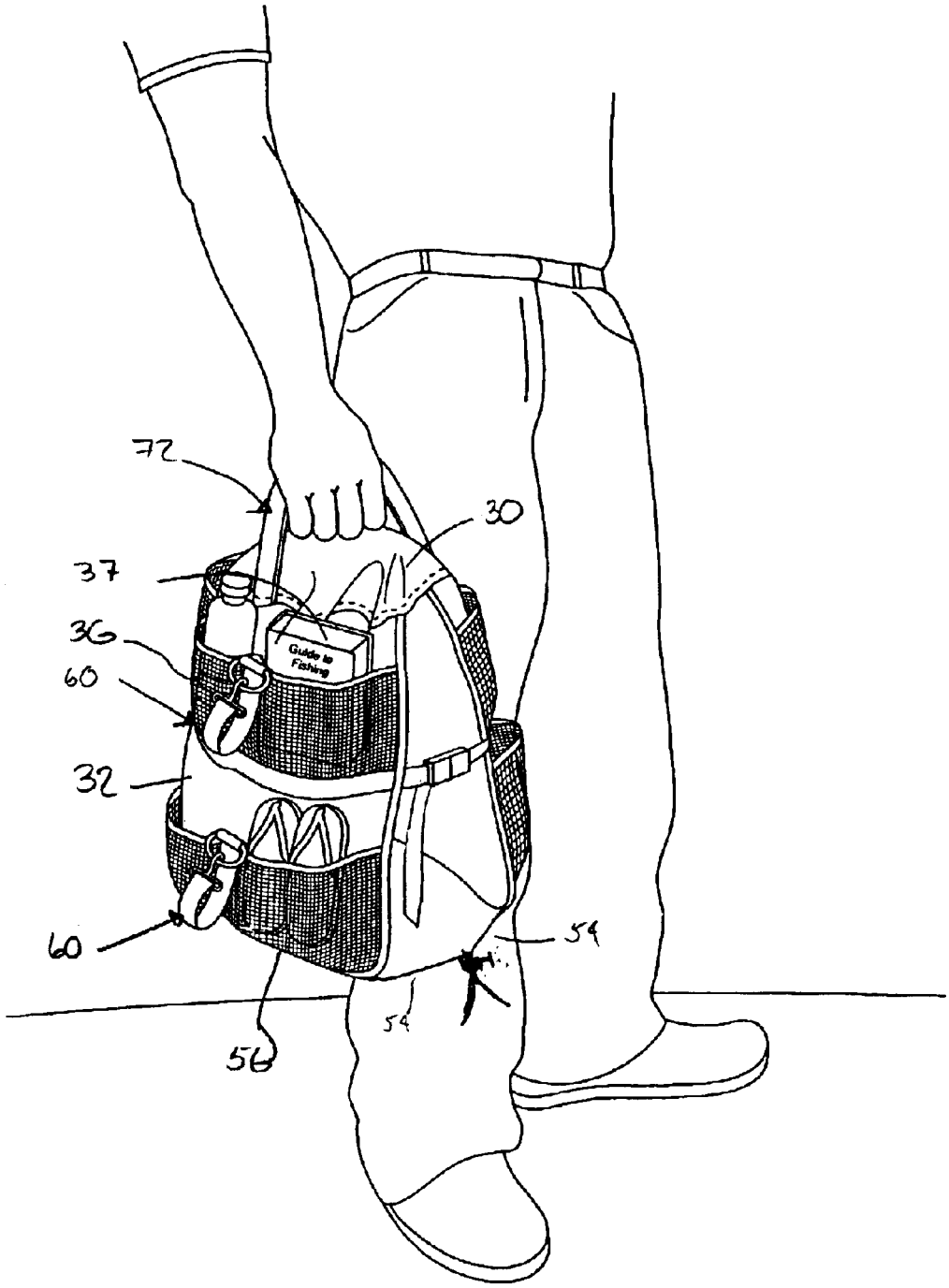
FIG. 3 shows the storage device being carried by its carrying strap.
Figure 4:
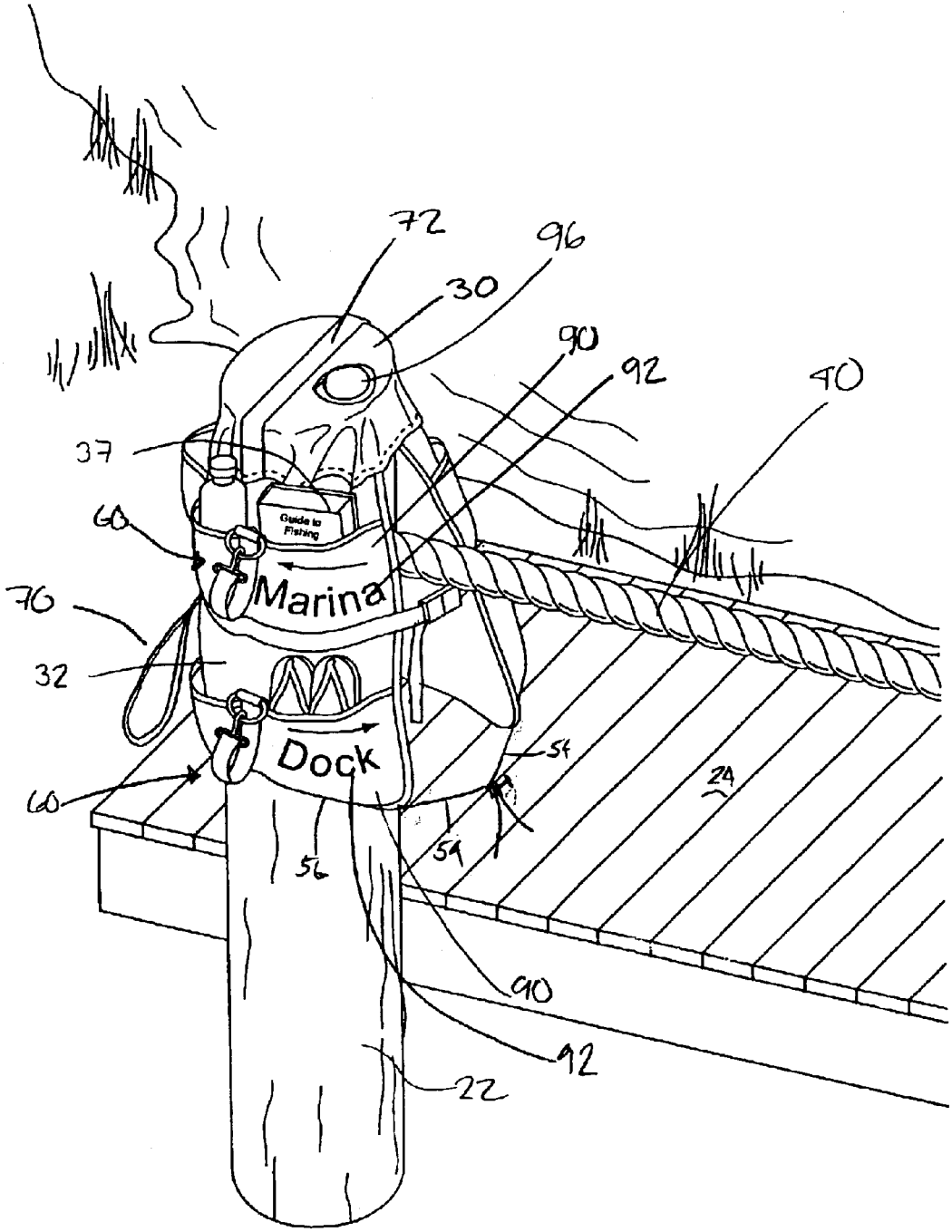
FIG. 4 shows the storage device with indicia on an indicia area.
Figure 5:
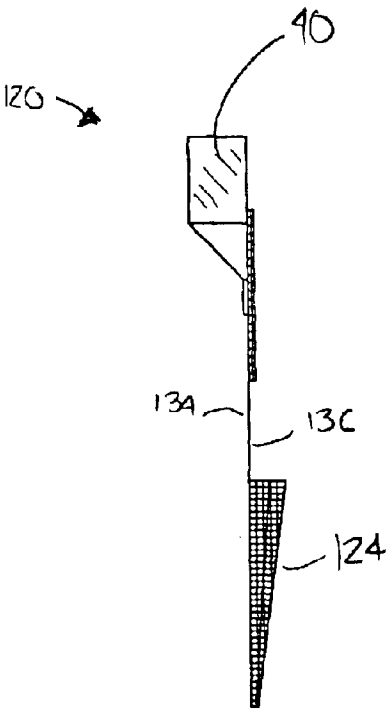
FIG. 5 shows a side view of an alternate embodiment of the present invention where the storage device is adapted to mount to a railing of the dock.

The mooring shown in FIGS. 1, 2 and 4 is of the type that is used on a dock 24 that is located on a body of water, such as a lake. The dock 24 is typically of the type that is used by homeowners for the docking of small pleasure boats. However, as will become apparent through the following disclosure, the dock storage device or mooring cover may also be used on commercial piers, in marinas, and in other applications where moorings, which may be considered as pilings or posts of a similar nature, for instance in boat yards or in dry docks. Additionally, the storage device 20 may be used on the moorings used to support the dock on the water or the posts that support the railings of the dock. The device 20 may be used on square or round cross-section moorings, which generally range in diameter from 5 to 20 inches.

The mooring cover 20 as shown in FIGS. 1 and 4 is adapted to be placed over the top of the mooring and rest on a top surface 26 of the mooring, and comprises a top covering 30 which as shown in FIGS. 1–4 is generally circular in shape, although other shapes may be used in accordance with the cross-sectional shape of the mooring on which the mooring cover is to be installed. The mooring cover 20 is provided with an apron 32 which extends downward from the top covering 30. The apron 32 has a generally rectangular shape such that when the apron is attached to a peripheral edge 34 of the top covering and the mooring cover 20 is placed on the mooring 22, the apron substantially takes the shape of a cylinder. The apron may also have the form of a frustum or cone when placed on the mooring. The apron need not be substantially continuous but may comprise another separate structure sufficient to support a pocket in a fixed location below the top covering. For instance, the apron may have the form of one or more narrow strap(s) that extend(s) from the top covering with a pocket positioned on the strap.

The apron 30 preferably has at least one pocket 36 formed thereon adapted to hold any number of boating accessories 37, such as by way of illustration and not by limitation: personal articles, books, keys, food and beverages, cellular phones, personal electronic equipment, rigging equipment, radios, flashlights, rope, sails and sail covers, common boating tools, boat cleaning equipment, sponges, rags, paint, brushes, cleaners or waxes. Preferably, a plurality of pockets 36 are provided on the apron 30 and the pockets 36 are arranged in an annular or ring-like configuration about the length of the mooring cover 20. Preferably, two rings of pockets, one below the other, are provided on the apron. The bottom ring of pockets may be formed with larger sized pockets to support relatively heavier items and the top ring of pockets may be of smaller size to hold lighter weight items, thereby promoting stability of the mooring cover when it is carried or installed on a mooring. The apron 30 need not be constructed as a panel to support the pockets but may be any other structure which would allow the pockets to be positioned around the mooring cover 20 when the mooring cover is placed on a mooring or post 22.

As shown in the FIGS. 1–4, the pocket 36 preferably consists of a rectangular piece of material which is stitched directly to the pocket support member around three of its four edges to create the pocket. Rather than providing several relatively small pieces of material to form individual pockets, to simplify construction, the pockets may be formed by arranging a single, relatively long and continuous piece of material across the apron and providing vertical stitching at spaced intervals to form a series of laterally adjacent pockets. The apron may also have a double-ply construction with holes through one ply to create the pockets on the mooring cover. The pocket may be pleated and have an open end 38 through which accessories are inserted into the pocket. The pocket 36 may also be provided with other mechanical fasteners such as snaps, hook and loop fasteners (e.g. Velcro™), elastic, zippers, or drawstring closures to restrict the pocket open end 38 to secure articles within the pocket. Some in the plurality of pockets 36 may be provided with a mesh material to allow water and dirt to escape the pocket, thereby being self draining. By providing relatively open mesh pockets, the contents of the pocket may also easily be identified. For this purpose, the pocket may also be made from transparent materials or have windows formed in the face of the pocket to allow visual identification of the contents of the pocket. Other pockets 39 (FIG. 1) in the plurality may be provided with a water resistant coating or material so that notes and other objects may be protected from environmental elements.

As shown in FIGS. 1, 2 and 4, when the mooring cover 20 is placed on top of the mooring 22, the apron 30 extends downward from the top covering 30 and surrounds the outer surface of the mooring. To accommodate railings 40 which may extend from the sides of the mooring 22, the apron 30 is preferably provided with a space or gap 42. As shown in the drawings (FIGS. 1, 4), the apron 30 is preferably in the form of a rectangular panel with first and second ends 44,46 such that when the apron has its top edge (i.e. length-wise edge) stitched to the top covering peripheral edge 34, the first and second ends 44,46 are spaced from another to create the space or vertical gap 42. The space or gap may also be formed in other ways. For instance, the apron may be one in a plurality of aprons that extend from the top covering so as to substantially surround the mooring. The adjacent aprons may be spaced apart from one another to provide the space or gap. The apron may be formed with slots and holes which are selectively opened and closed depending upon the configuration of the mooring or railing. By way of example, the holes and slots may be arranged on the apron so that the mooring cover may fit on a mooring having railings at 180 degrees apart from each other such as in a mid-span post, or the holes and slots may be arranged on the apron so that the mooring cover may fit on a post or other vertical support structure having railings formed at 90 degrees apart from each other, for instance, for accommodating a corner post. A system of fasteners may be provided adjacent the holes and slots to open and close the slots and the holes as needed. These fasteners may also be arranged on the mooring cover to help stabilize the mooring cover when it is installed on the mooring. For instance, when the slot and hole configuration is not needed because of the arrangement of the mooring, the slots and holes may be closed using the fasteners to allow the mooring cover to better conform to and surround the outer surface of the mooring.

To help stabilize the mooring cover 20 when it is placed on the mooring 22, a strap 50 may be provided on the apron 30 to draw the apron inward in contact with the mooring. As shown in the FIGS. 1, 2 and 4, an adjustable strap 50 with snap connection 52 is preferably provided at the mid-section of the apron to extend across the space 42 to bring the first and second ends 44,46 of the apron together around the mooring. Hook and loop fasteners, snaps, zipper or other mechanical fasteners arranged along adjacent edges of the apron (for instance, the first and second ends as shown in FIGS. 1 and 4) may also be used to stabilize and secure the mooring cover on the mooring. For further support, a closure 54, such as a drawstring, elastic band or a second strap, may be provided on the separated ends 56 of the apron 30 to draw the ends of the apron inward against the mooring.

Preferably, the mooring cover 20 is provided with an attaching mechanism or strap attachment 60. The strap attachment 60 may be a lanyard 62 and a clip 64 having sufficient length to secure an irregularly shaped or oversized object to the storage device. As shown in FIG. 1, the strap attachment in the form of a lanyard and clip is used to secure rope 66 to the mooring cover. Such a strap attachment may also be used to support a bag 67, ring buoy or other object to the mooring cover. However, the strap attachment may also be D-rings, snap rings, clips, key rings, grommets, or straps, any of which would provide versatility and convenience in attaching any number of desired items to the mooring cover. Preferably, a plurality of strap attachments are provided on the mooring cover, each having a different size and configuration to provide several convenient and versatile ways to attach other common personal items, such as keys and tools, to the mooring cover. The strap attachments 60 are preferably arranged on the apron in positions that do not interfere with use of the pockets.

The mooring cover may also be provided with a handle 70 (FIG. 4) which may have the form of a loop strap that extends from the pocket support member such that the handle is accessible to one boarding or unboarding a boat moored next to the mooring on which the mooring cover is mounted.

To facilitate carrying of the mooring cover, a carrying strap 72 is preferably attached to opposing sides of the top covering 30. This strap may also be used to secure the mooring cover to a mooring and may also be used as an alternative to the handle 70 for people moving between the dock and the boat.

As shown in the drawings (FIGS. 1 and 4), the mooring cover top covering 30 essentially has a shape which closely matches the cross-sectional shape of the mooring 22. By providing a spool adapter 74 (FIG. 2.), the storage device may be fitted to moorings 76 having a smaller diameter such as the posts that are used on mid-span locations of the dock to support the dock handrails, or posts having a different cross sectional shape, for instance, interfacing a storage device having a round-shaped top to a square post. In one embodiment, the adapter spool 74 may be arranged with a top flange 78 and a bottom flange 80 and a hollow core 82 between the two. The top flange 78 has a shape which corresponds to the shape of the mooring cover top covering 30 and the bottom flange 80 has a shape which corresponds to the shape defined by the distal or lower end 56 of the mooring cover. The hollow spool core 82 has an open end 84 adjacent the bottom flange 80 and a closed end 86 adjacent the top flange 78 such that the spool can be slipped over the post exposed top end 77 with the spool closed end 86 resting on the post exposed top end. The mooring cover 20 can then be slipped over the adapter or spool 74 with the mooring cover top covering 30 resting on the adapter top flange 78. Mechanical fasteners, such as set screws 88, may also be used to provide further support in holding the adapter 74 in a fixed position on the post 76.

In an alternative construction, the adapter or spool may be constructed with a longitudinal hinge or flexible member and an opposite longitudinal slit. By opening the longitudinal slit, the adapter or spool may be wrapped around the post and held in position on the post with straps or mechanical fasteners extending across the slit, for instance screws, u-bolts or a cam actuated handle or clamp. In this configuration, the spool may have an inward springing bias such that the spool is urged against and conforms around the post when it is opened at its slit and placed around the post. The spool may also be provided as a two-piece assembly similar to a split barrel where the two pieces are placed on either side of the post and held together and in contact with the post by a strap or other similar type of mechanical fasteners, such as a u-bolt. In each instance, it is not necessary that the spool have a tight fit with the post. For instance, the spool may be positioned around the post and held in the proper vertical position on the post through use of a mechanical fastener or other clamp device that attaches to and fits around the post. The spool and/or the spool bottom flange may then rest on the clamp or mechanical fastener. The spool may also be positioned in a fixed vertical position on the post 76 solely by fasteners directed through the core that engage the post, for instance, the set screws 88 shown in FIG. 2.

Preferably, the mooring cover 20 is provided with an indicia area 90 (FIG. 4), which is exposed to viewing when the mooring cover is placed on the dock piling 22. The indicia area 90 may be formed on the apron and may include the outer surfaces of the pockets themselves. Preferably, indicia 92 are placed on the indicia area 90 such that the indicia is visible from an area adjacent to the dock and/or the mooring. The indicia 92 may include advertisements, information about a marina, specific characteristics about a dock or its location, mooring conditions, wake zones or other channel markings. The indicia 92 may include color coding in accordance with these purposes or the indicia may serve a decorative purpose to improve or unify the appearance of the dock area. The indicia 92 may also comprise advertisements, logos, other promotional material or personalized information.

The mooring cover 20 may also be provided with a light 96 which may be powered through solar panels positioned on the mooring cover. The light may also be powered via a battery or through an electrical connection using wiring provided in the mooring cover for connecting to a dock power supply. The light may also be used to identify the mooring or its location, or may have enough strength to provide illumination in a wide area about the dock or as a navigational aid. The mooring cover may have a mechanism for locking the mooring cover onto the mooring to deter theft.

The mooring cover 20, including the apron and the top covering, may be constructed from any flexible material providing a reasonable degree of resistance to weathering, water and exposure to sunlight. A preferred material is acrylic fabric, such as that manufactured by Glen Raven Mills, Inc and marketed as Sunbrella™. Other suitable materials include nylon, polypropylene, treated cotton, rayon, polyester, PVC, urethane and the like. These materials may be coated to enhance weathering resistance, color fastness and the like. The mooring cover material may also include reflective materials and photoluminescent materials to facilitate location of the storage device at night. The mooring cover may also be made from a material that provides a sufficiently strong and durable material that shields individuals from splinters which they might otherwise receive from brushing up against an exposed rough cut mooring. The mooring cover may also be made from more rigid or resilient materials (foams or rubber) to protect the mooring from inadvertent contact from boats and other objects that might otherwise strike the mooring. Other materials for the mooring cover having the aforementioned properties are likely known to those skilled in the art.

The pockets may be constructed from any flexible material providing a reasonable degree of resistance to weathering, water and exposure to sunlight. A preferred material is vinyl coated polyester, such as Phifertex™ manufactured by Phifer Wire Products . Other acceptable materials include acrylic, nylon, polypropylene, treated cotton, rayon, polyester, PVC, urethane and the like. These materials may also be coated to enhance weathering resistance, color fastness and the like. Materials may also be elasticized to provide additional conformance to the contents of the pockets. The material may have a mesh form to provide the self-draining characteristic. Alternatively, the pocket may be formed with drain holes formed therein to permit water and dirt to escape the pocket. Other materials having the aforementioned properties are likely known to those skilled in the art.

The straps included on the mooring cover may be constructed from any suitable webbing material possessing adequate strength and resistance to weathering, water and exposure to sunlight. A preferred material is nylon. Suitable alternative materials include polypropylene, treated cotton, rayon, polyester, PVC, urethane and the like. These materials may be coated to enhance weathering resistance, color fastness and the like. Other materials having the aforementioned properties are likely known to those skilled in the art.

Assembly of the present invention is preferably accomplished with polyester thread. Other suitable materials include nylon, polypropylene, treated cotton, rayon, polyester, PVC, expanded polytetrafluorethlene, urethane and the like. These materials may be coated to enhance weathering resistance, color fastness and the like. Alternatively, the elements of the invention may be assemble using adhesives, mechanical fasteners such as rivets or, with suitable material selection, heat sealing. Other materials having the aforementioned properties are likely known to those skilled in the art.

In an alternate embodiment of the storage device 120 as shown in FIGS. 5 and 6, the mooring cover is adapted to fit around the railing 40 of the dock. The railing may be a rigid member or may be rope. In this embodiment, the apron 122 is preferably formed as a rectangular panel with two rows of pockets 124 arranged across the panel. The apron 122 has a flap 126 attached to its top edge 127 which is of sufficient length 128 to wrap around the railing. The flap has a fastener 130 on its upper edge 132 which preferably releasably attaches to a back side 134 of the apron to wrap around and thereby support the flap from the railing 40. In securing the mooring cover to the railing, the flap fastener 130 may also be arranged on the flap 126 to releasably attach to the flap or to releasably attach to a front side 136 of the apron, for instance by directing the flap around the railing in a clockwise direction (FIG. 5). The flap 126 may have its upper edge 132 formed with a plurality of mechanical fasteners which releasably attaches to the apron. For instance, the plurality of mechanical fasteners may include strips of hook and loop material applied on each of the respective flap upper edge 132 at spaced locations therealong as well as along matching locations of the apron top edge 127. The strips of cooperating hook and loop material on the apron and flap allow a variable length of the flap 126 to be placed around the railing 40 and secured to the apron thereby accommodating different cross sections of railings. This also may be accomplished by providing a wide band of hook and/or loop material on the flap upper end 132 or on the apron back side 134. Additionally, the adjustability feature of the flap and apron may be accomplished through the use of a plurality of buttons or snaps arranged on the flap 126 at different lengths 128 from flap upper edge 132 or the apron top edge 127, each, in effect, providing a variable length of the flap to hold the mooring cover on the railing.

As shown in FIG. 6, the flap 126 is preferably a continuous piece of material that runs the entire length of the apron 122. The flap 126 may also be one of a series of flaps that may be independently used to secure a portion or the entirety of the mooring cover to the railing. For instance, the mooring cover may be provided with three flaps (two end flaps separated by a middle flap) that extend along the length of the apron thereby allowing use of the two end flaps to support the mooring cover on the railing and the middle flap being folded down along the back of the apron to accommodate a railing support post or mooring. The flap may also be one of several flaps in a plurality of flaps which are narrow in width and spaced from one another along the length of the apron. Thus, in the example of placing the mooring cover on a railing with a post, the mooring cover may be placed in a position on the railing such that the post or mooring is aligned with a space between adjacent flaps.

Figure 7:
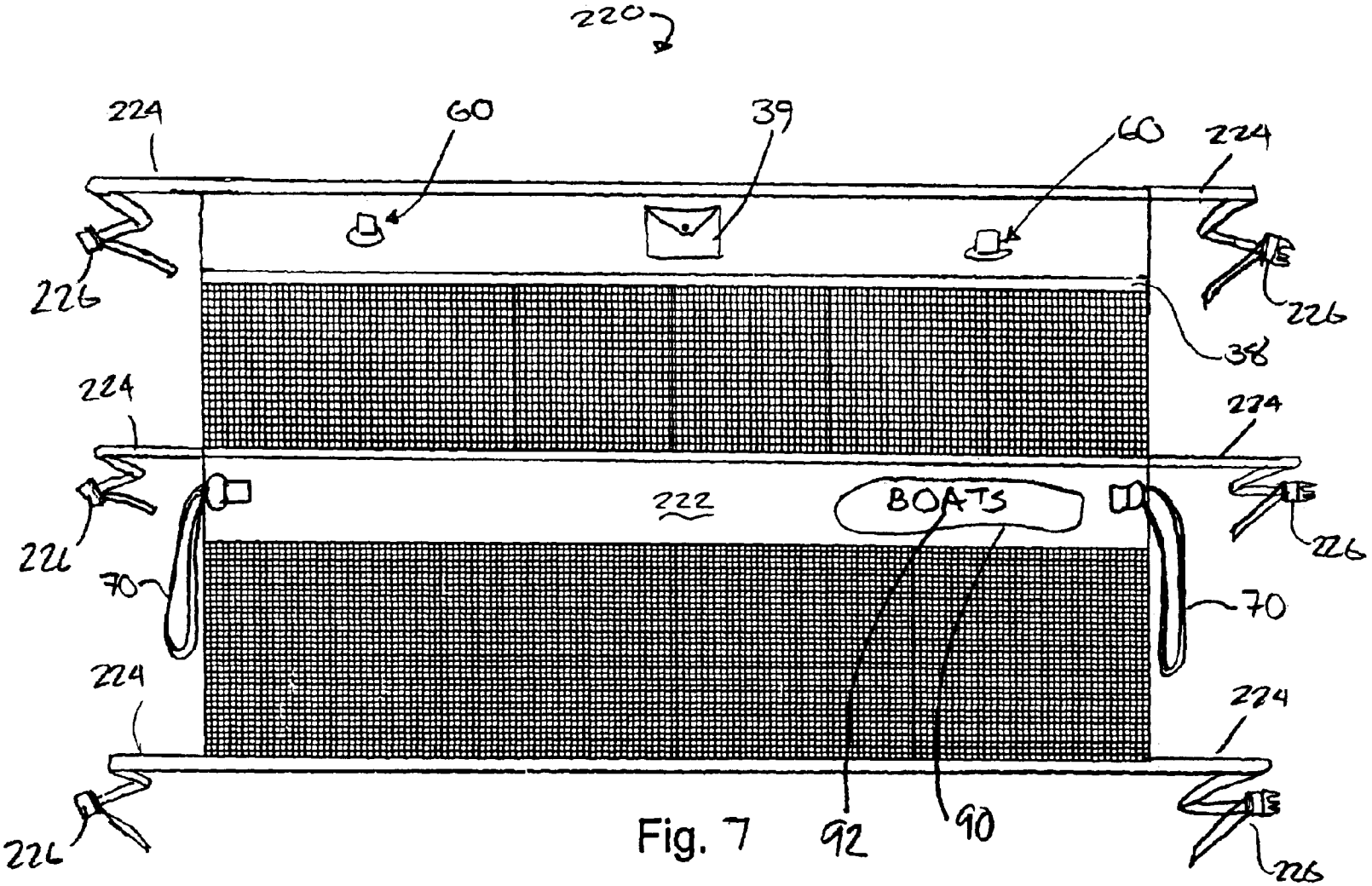
FIG. 7 shows still another alternate embodiment of the storage device of the present invention which has a plurality of straps which allows it to be wrapped around a mooring.

FIG. 7 shows an alternate embodiment of the mooring cover 220 where the mooring cover comprises an apron 222 having a flat rectangular construction which may be wrapped around the mooring and held in place thereon with straps 224 or other mechanical fasteners. These fasteners may include zippers, mechanical snaps, clips, buckles, or other hook and loop fasteners, as described above. In this way, when the mooring cover is installed on the mooring or dock post, the storage device 220 would be arranged as a partial or complete cylinder with open top and bottom ends such that the mooring top surface is exposed. Preferably, a series of straps 224 are provided at the top, middle, and bottom of the apron. Each of the straps 224 may be provided with a snap connector and adjustable clip 226 to allow the straps to be tensioned to hold the mooring cover 220 in a fixed vertical position on the mooring. The adapter 74 described previously may also be used in conjunction with this embodiment of the mooring cover 220 by first positioning the adapter on the mooring and then positioning the mooring cover around the adapter and tensioning the straps such that the mooring cover is held tightly against the adapter and in a fixed vertical position relative to the mooring.

As can be seen from the above description, the mooring cover or dock storage device provides a simple and effective tool for storing ones personal items on a dock. The mooring cover provides a convenient way to store needed items that are used on a boat thereby increasing dock and boating safety. The mooring cover may also be used to protect individuals from pilings and to protect the pilings from inadvertent contact with other objects which might otherwise cause damage to the mooring. The mooring cover device provides a convenient way to provide instructions and other information to boaters that might be moored adjacent the piling on which the device is installed. The mooring cover as described above satisfies many functional features that are needed at a dock and provides many advantages which increase the overall enjoyment of boating.

As various changes could be made in the above constructions and methods without departing from the scope of the invention, it is intended that all matter contained in the above description or shown in the accompanying drawings shall be interpreted as illustrative and not in any limiting sense. The invention therefore shall be limited solely by the scope of the claims set forth below, and their legal equivalents.

What is claimed is:

1. A method comprising:

providing a mooring supporting a dock;

providing a mooring cover comprising an apron having a plurality of self draining pockets arranged along its length for storing boating accessories, and a fastener attached to opposite edges of the apron;

positioning the mooring cover around the mooring in a manner such that the apron substantially surrounds the mooring and the mooring cover is supported by the mooring; and securing the fastener to thereby join the opposite edges of the apron and thereby secure the mooring cover to the mooring.

2. The method of claim 1 wherein the mooring cover further comprises a top covering attached to the apron along a top peripheral edge of the apron and a carrying strap attached to opposite edges of the top covering; the method further comprising carrying the mooring cover by the carrying strap in a manner such that the apron extends downward from the top covering.

3. The method of claim 2 wherein the step of placing the mooring cover around the mooring includes using the carrying strap to position the mooring cover top covering over an exposed top surface of the mooring and lowering the mooring cover in a manner such that the apron substantially surrounds the mooring and the top covering is positioned on the mooring exposed top surface.

4. The method of claim 1 wherein the mooring cover further comprises a strap attachment on the apron, and the method further comprises using the strap attachment to hold a boating accessory on the mooring cover.

5. The method of claim 1 wherein the mooring cover further comprises a handle; and the method further comprises using the handle to facilitate moving between a boat and the dock.

6. The method of claim 1 wherein the step of positioning the mooring cover around the mooring comprises first placing a spool adapter on the mooring such that the spool adapter substantially surrounds the mooring and is supported thereby and then placing the mooring cover around the mooring by placing the mooring cover around the spool adapter such that the mooring cover substantially surrounds and is supported by the spool adapter.

* * * * *